US008746266B2

(12) United States Patent
Palmer et al.

(10) Patent No.: US 8,746,266 B2
(45) Date of Patent: Jun. 10, 2014

(54) APPARATUS FOR ESTABLISHING DYNAMIC GROUND CONTACT

(71) Applicants: William Palmer, Columbus, OH (US); Paul Reeder, Worthington, OH (US)

(72) Inventors: William Palmer, Columbus, OH (US); Paul Reeder, Worthington, OH (US)

(73) Assignee: Towzer Sports, LLC, Columbus, OH (US)

( * ) Notice: Subject to any disclaimer, the term of this patent is extended or adjusted under 35 U.S.C. 154(b) by 0 days.

(21) Appl. No.: 13/627,598

(22) Filed: Sep. 26, 2012

(65) Prior Publication Data

US 2013/0074893 A1 Mar. 28, 2013

Related U.S. Application Data

(60) Provisional application No. 61/538,979, filed on Sep. 26, 2011.

(51) Int. Cl.
*A45B 9/04* (2006.01)

(52) U.S. Cl.
USPC ..... 135/84; 135/86; 135/82

(58) Field of Classification Search
USPC ..... 135/77, 82, 84, 86; 280/826
See application file for complete search history.

(56) References Cited

U.S. PATENT DOCUMENTS

| | | | | |
|---|---|---|---|---|
| 1,429,429 | A * | 9/1922 | Hipwood | 135/84 |
| 2,230,406 | A * | 2/1941 | Johnson | 135/77 |
| 3,040,757 | A * | 6/1962 | Smith | 135/86 |
| 5,088,513 | A * | 2/1992 | Ostermeyer | 135/82 |
| 5,236,222 | A * | 8/1993 | Fletcher | 280/809 |
| 6,910,246 | B2 * | 6/2005 | Desmarais | 16/42 R |
| 8,465,056 | B2 * | 6/2013 | Weir et al. | 280/819 |
| 8,636,306 | B2 | 1/2014 | McBride | |
| 2004/0025926 | A1 * | 2/2004 | Gin et al. | 135/68 |
| 2010/0307549 | A1 * | 12/2010 | Goodwin | 135/82 |
| 2011/0101664 | A1 | 5/2011 | Gonzalez | |

* cited by examiner

*Primary Examiner* — David R Dunn
*Assistant Examiner* — Danielle Jackson
(74) *Attorney, Agent, or Firm* — Standley Law Group LLP

(57) ABSTRACT

An apparatus for establishing dynamic ground contact is disclosed. A ground contact tip is attached to one end of an elongate member. The ground contact tip contains a connecting portion and a base portion that is opposite the connecting portion. A flexible core connects between the base portion and the connecting portion. At least one limiting ring is positioned on the flexible core. The elongate member is permitted to rotate through a range of angles while the flexible core allows the base portion to remain flat against the ground. At the maximum allowable angle, the limiting rings allow the ground contact tip to cease flexing and become rigid, so that the user can push against the ground at an angle, while the base portion remains flat against the ground.

19 Claims, 3 Drawing Sheets

APPARATUS FOR ESTABLISHING DYNAMIC GROUND CONTACT

CROSS-REFERENCE TO RELATED APPLICATIONS

This application claims priority to co-pending U.S. Application No. 61/538,979 filed on Sep. 26, 2011 which is hereby incorporated by reference in its entirety.

TECHNICAL FIELD

Embodiments generally relate to an apparatus for establishing dynamic ground contact and may be used with an elongate member so that an individual can apply stable forces to the ground while moving, sometimes at a high rate of speed.

BACKGROUND ART

The sport of skateboarding was originally born by surfers who had a desire to practice their surfing balance and technique when there were no waves or simply as an alternate mode of transportation. As skateboarding has evolved, two primary types of skateboards are now offered by retailers. The first is a 'trick skate' which is commonly seen in skateparks and halfpipes as a short symmetrical board which can be flipped around by the rider to perform various maneuvers/tricks. The second is a 'longboard' which is used primarily for transportation rather than the maneuvers/tricks which are commonly performed on a trick skate. The longboard is typically longer than the trick skate and is not usually a symmetrical shape. The additional length of the longboard results in a more stable ride, which lends itself nicely to high speed travel over long distances.

As the sport of surfing continued to evolve, the sport of stand up paddleboards (SUP) has now become popular. In traditional surfing, the rider must travel across the water by paddling with their arms and when it's time to catch the wave, must stand up on the board while maintaining their balance and speed. This can be difficult to do, especially for new surfers or surfers who lack strength in their arms and shoulders. With SUP, the rider is already standing on the board and uses a paddle to actually maneuver across the water and catch a wave. Once in position, the wave is easier to catch and ride as the rider is already in the riding position.

In typical longboard skateboarding, the rider propels the longboard by 'pumping' or leaving one foot on the board while pushing against the ground with the other foot. At higher rates of speed, this technique is not desirable by longboarders as you may lose your balance and you also have very limited turning/edging control while pumping. The SUP technique has now been adopted by the longboard skateboarders and is sometimes referred to as 'land paddling.' In this technique, the user holds an elongate member (similar to the paddle for a SUP) in their hands and makes contact with the ground using this elongate member rather than their foot. This technique is desirable for longboard skateboarders as it allows them to keep both feet on the deck and control the turning of the board while increasing their speed.

In the existing devices used for land paddling, there has not been an adequate connection between the elongate member and the ground. To be effective at all, many of the prior devices require that the 'tip' of the elongate member is oriented in a certain way (in other words, the rider must rotate the elongate member and/or tip so that they were positioned properly for engaging with the ground). Further, the devices were only effective at certain speeds and when placed at certain angles relative to the ground. When used outside of these acceptable parameters, the prior art devices do not establish adequate contact with the ground and maintain this contact throughout the rider's pushing motion. In other words, the rider's range of motion is limited and the effectiveness of their 'push' is also limited.

SUMMARY OF THE EXEMPLARY EMBODIMENTS

An exemplary embodiment of the invention uses a ground contact tip with an elongate member where the ground contact tip is permitted to flex so that ground contact can be established even when the elongate member is at extreme angles relative to the ground. A flexible core is preferably used to connect a base portion with a connecting portion (or transition shoulder) and may have one or more limiting rings placed along the flexible core. As the ground contact tip encounters the ground, the flexible core is permitted to flex so that the base portion may establish positive contact with the ground in a quick and easy manner. Throughout the rider's push, the flexible core continues to flex, allowing the elongate member to swing through a range of angles, while maintaining contact with the ground.

In some embodiments the limiting rings may be used to limit the amount of flex permitted by the flexible core. This has been found to provide additional force and stability to the rider during the push. The elongate member may be equipped with length-adjusting features to accommodate riders of different heights as well as allowing the elongate member to collapse for storage/transportation.

Although exemplary embodiments have been shown and described for use in skateboarding activities, various embodiments herein can also be used with other devices which contact the ground and assist the user in movement. For example, crutches, canes, and/or walkers also require contact with the ground through a range of angles and motion. Therefore, exemplary embodiments can also utilize the ground contact tip with various types of crutches, canes, and/or walker devices.

The foregoing and other features and advantages of the present invention will be apparent from the following more detailed description of the particular embodiments, as illustrated in the accompanying drawings.

BRIEF DESCRIPTION OF THE DRAWINGS

A better understanding of an exemplary embodiment will be obtained from a reading of the following detailed description and the accompanying drawings wherein identical reference characters refer to identical parts and in which.

DETAILED DESCRIPTION

Figure 1:
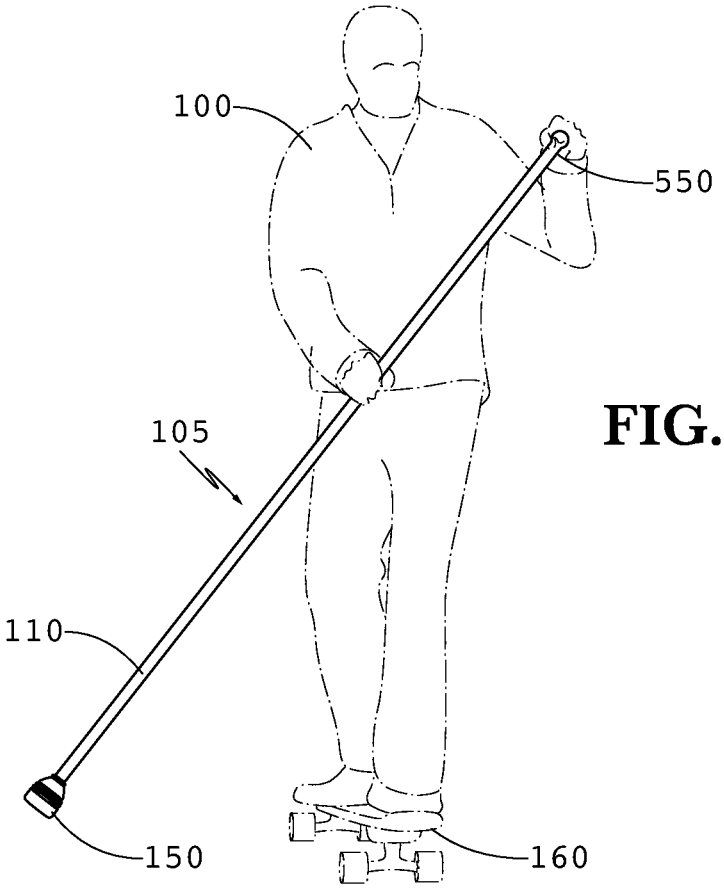
FIG. 1 is a perspective illustration of a skateboard rider using an exemplary embodiment of the dynamic ground contact apparatus.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a perspective illustration of a skateboard 160 rider 100 using an exemplary embodiment of the dynamic ground contact apparatus 105. An elongate member 110 preferably has a first and second end where the first end contains a grip 550 and the second end contains the ground contact tip 150.

Figure 2:
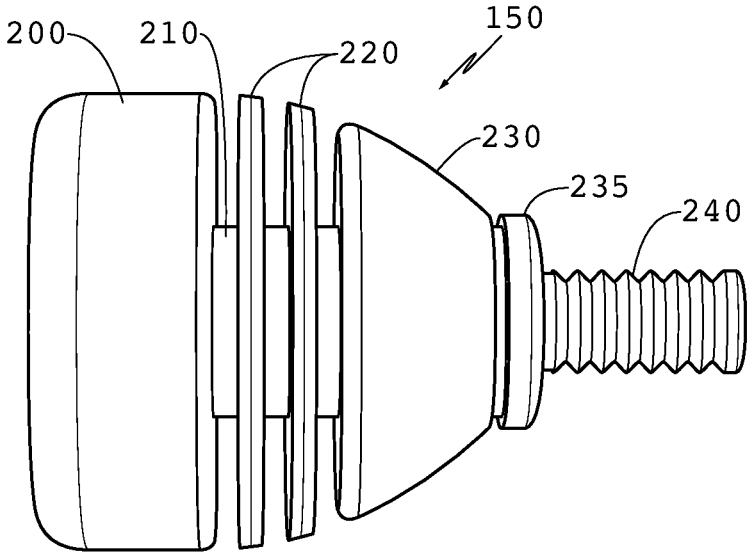
FIG. 2 is a side elevation view of an exemplary embodiment of the ground contact tip.

FIG. 2 is a side elevation view of an exemplary embodiment of the ground contact tip 150. A base portion 200 is preferably placed at the bottom of the ground contact tip 150 and is generally shaped as a disc which is axially symmetrical about a central axis. A connecting portion 235 is preferably placed at the top of the ground contact tip 150 and may be adapted to attach to the elongate member 110 by any number of attachment means. In this embodiment, the attachment means is provided as a threaded member 240 which is preferably threaded into the elongate member 110. Other embodiments may use a set screw, pin, locking collar, or any other means for attaching the contact tip 150 to the elongate member 110.

A transition shoulder 230 may be used to expand the diameter of the connecting portion 235 to a diameter that is closer to that of the base portion 200. It should be noted that the transition shoulder may not expand the diameter (or may not be required at all) when the connecting portion 235 has a diameter that is close to the diameter of the base portion 200. A flexible core 210 preferably connects between the base portion 200 and the transition shoulder 230 (or directly to the connecting portion 235 if no transition shoulder 230 is used). One or more limiting rings 220 are preferably placed along the flexible core 210 to limit the amount of flex that is permitted in the flexible core 210. The flexible core 210 preferably has a smaller diameter than the base portion 200 and the limiting rings 220 (as well as the bottom portion of the transition shoulder 230, if used). Preferably, the diameter of the limiting ring 220 is at least twice the size of a diameter of the flexible core 210. In an exemplary embodiment, the outer diameters of the limiting rings 220 are approximately equal to the outer diameter of the base portion 200. In the specific embodiment shown in FIG. 2, the outer diameters of the limiting rings 220 increase as one moves from the transition shoulder 230 to the base portion 200.

Figure 3:
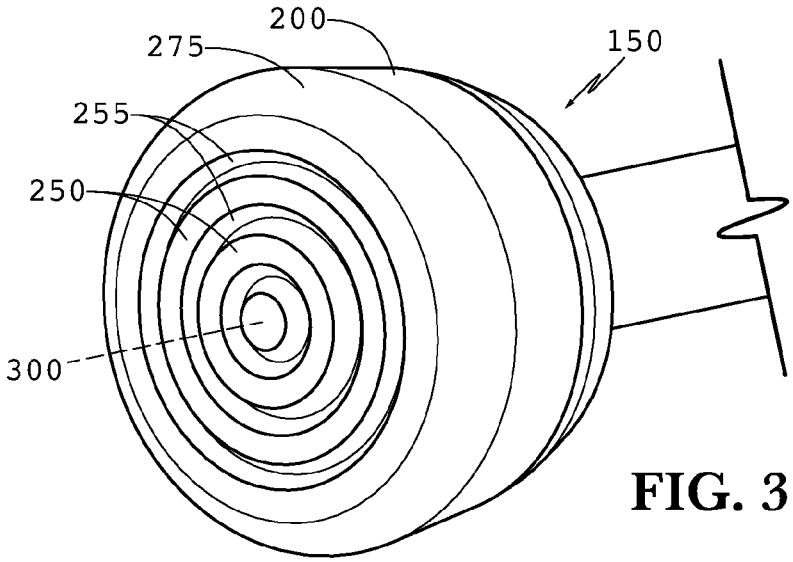
FIG. 3 is a perspective bottom view of an exemplary embodiment of the ground contact tip.

FIG. 3 is a perspective bottom view of an exemplary embodiment of the ground contact tip 150. The bottom surface of the bottom portion 200 may contain a plurality of raised concentric tread rings 250 with a recessed tread surface 225 in between each pair of tread rings 250. The perimeter of the bottom surface may contain a gentle round 275 so that the ground contact tip 150 can quickly roll into a position flat against the ground even when initially placed at an angle relative to the ground. It is preferable that the ground contact tip 150 is axially symmetrical about a central axis 300 so that the apparatus may function properly despite the rotational position of the ground contact tip 150.

Figure 4:
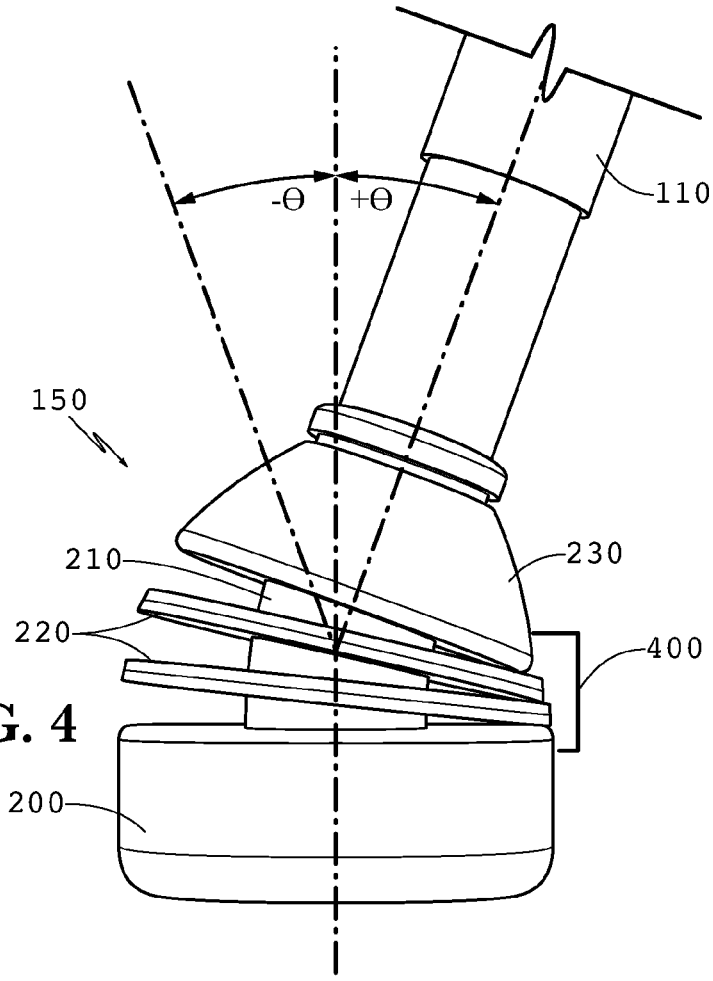
FIG. 4 is a side illustration of an exemplary embodiment of the apparatus where the ground contact tip is establishing dynamic ground contact as the elongate member sweeps through $+/-\theta$ relative to the ground.

FIG. 4 is a side illustration of an exemplary embodiment of the apparatus where the ground contact tip 150 is establishing dynamic ground contact as the elongate member 110 sweeps through +/−θ relative to the vertical axis. In this figure, even though the central axis of the elongate member 110 is positioned at angle θ relative to vertical, the base portion 200 is flat against the ground. Thus, the entire bottom surface area of the base portion 200 is engaged with the ground despite the fact that the elongate member 110 is at angle θ relative to vertical. In this position, the portion 400 of the ground contact tip 150 that is below the elongate member 110 is compressed until the bottom portion 200, limiting rings 220, and transition shoulder 230 are adjacent to one another (or stacked next to one another). In other words, the flexible core 210 is permitted to flex only until this stacking phenomenon is observed in portion 400. This technique of limiting the total flex may provide the user with an increased amount of force and stability at the end of their push.

As can be observed from the figure, the elongate member is permitted to sweep from +θ, through vertical, and up to −θ while the base portion 200 maintains positive contact with the ground. Therefore, the base portion 200 establishes positive contact early in the push, maintains this contact throughout the push, and the limiting flex phenomenon provides increased force at the end of the push. All of these factors taken together create a much more comfortable, efficient, and powerful push. When the elongate member 110 is a portion of a crutch, cane, or walker, it allows the user to quickly establish positive contact with the ground with a smooth sweeping motion as the user moves forward with the crutch, cane, or walker.

The angle θ may be defined as the angle of the elongate member 110 relative to horizontal where the stacking phenomenon is observed in portion 400. While θ could vary between 25 degrees and 70 degrees with acceptable results, exemplary results have been found where θ is between 40 degrees and 50 degrees.

Figure 5:
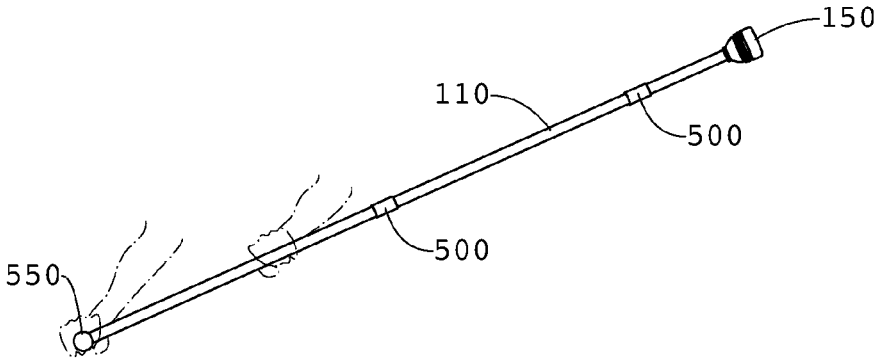
FIG. 5 is an illustration of an embodiment of the apparatus containing several length-adjusting features and a rounded grip at the end of the elongate member.

FIG. 5 is an illustration of an embodiment of the apparatus containing several length-adjusting features 500 and a rounded grip 550 at the end of the elongate member 110. In some embodiments, the length-adjusting features 500 may be threaded locking collars which allow adjacent portions of the elongate member 110 to slide within one another until the threads on the locking collar are tightened. In other embodiments, the length-adjusting features 500 may be spring-loaded protrusions which, when compressed allow the adjacent portions of the elongate member 110 to slide within one another and when released will create an outward force until filling any number of pre-drilled holes within the elongate member 110.

The elongate member 110 may contain a grip 550 which may be rounded and comfortable for the user to maneuver. The grip 550 may also be axially symmetrical about a central axis so that the user can grasp the grip in any rotational position and operate the dynamic ground contact apparatus. Although not required, an exemplary embodiment may use any one of the following materials for the grip 550: rubber, wood, plastic, composite, or elastomer.

While not required, an exemplary elongate member 110 may be a plastic or metal pole. Specifically, hollow aluminum tubing has been found to be an exemplary material for the elongate member 110. The ground contact tip 150 is preferably comprised of some type of rubber or elastomer. Materials with a durometer between 65 and 90 have been found to perform adequately. Specifically, 80 durometer shore A rubber has proven to be an exemplary material.

Figure 6B:
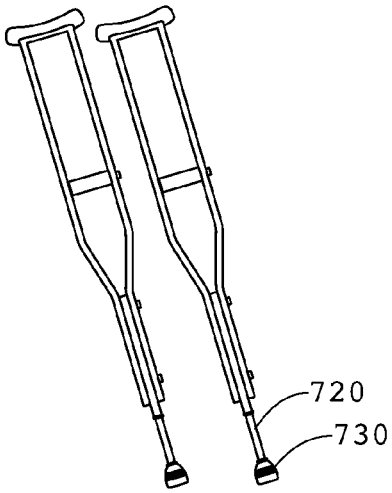
FIGS. 6A-6D are illustrations of various walking devices used with an embodiment of the ground contact tip.
Figure 6D:
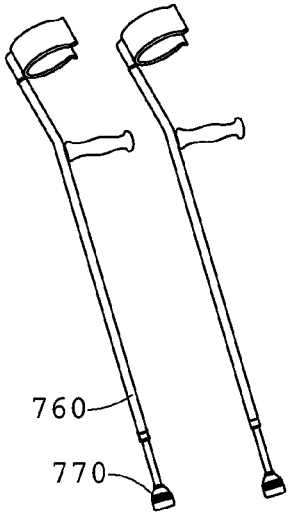
Figure 6A:
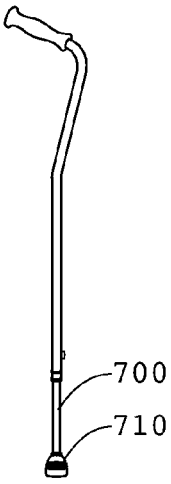
Figure 6C:
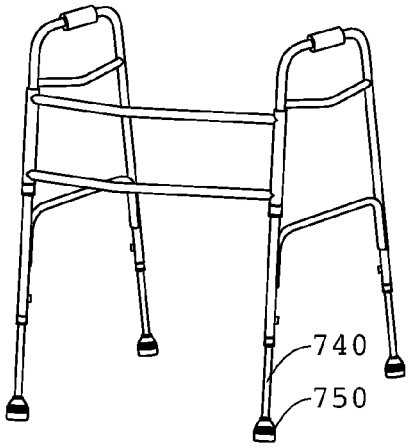

FIGS. 6A-6D are illustrations of various walking devices used with an embodiment of the ground contact tip. FIG. 6A provides a cane having an elongate member 700 with an exemplary embodiment of the ground contact tip 710. FIG. 6B provides a set of crutches having elongate members 720 with an exemplary embodiment of the ground contact tip 730. FIG. 6C provides a walker having elongate members 740 with an exemplary embodiment of the ground contact tip 750. FIG. 6D provides elbow crutches with elongate members 760 with an exemplary embodiment of the ground contact tip 770.

It is to be understood that the spirit and scope of the disclosed embodiments are not limited to longboard skateboards, as they could also be used with other types of skateboards, in-line skates or roller skates, and off-road boards.

Having shown and described a preferred embodiment of the invention, those skilled in the art will realize that many variations and modifications may be made to affect the described invention and still be within the scope of the claimed invention. Additionally, many of the elements indicated above may be altered or replaced by different elements which will provide the same result and fall within the spirit of the claimed invention. It is the intention, therefore, to limit the invention only as indicated by the scope of the claims.

We claim:

1. An apparatus for establishing ground contact with an elongate member, the apparatus comprising:
- a connecting portion;
- a base portion positioned opposite the connecting portion;
- a flexible core connecting the base portion with the connecting portion; and
- a first and second limiting ring positioned on the flexible core, each ring having a diameter and a thickness and
- where the distance between the connecting portion and the first ring, the distance between the first ring and second ring, the distance between the second ring and the base, and the thicknesses of the first and second rings are substantially equal to one another.

2. The ground contact apparatus of claim 1 wherein:
- the base portion is symmetrical about a central axis.

3. The ground contact apparatus of claim 1 wherein:
- the base portion has a diameter which is larger than a diameter of the connecting portion.

4. The ground contact apparatus of claim 1 further comprising:
- a transition shoulder positioned between the connecting portion and the limiting ring.

5. The ground contact apparatus of claim 4 wherein:
- the transition shoulder increases in diameter as you move from the connecting portion towards the limiting ring.

6. The ground contact apparatus of claim 4 wherein:
- the flexible core is adapted to bend until the limiting ring is sandwiched in between the transition shoulder and the base portion.

7. The ground contact apparatus of claim 1 further comprising:
- a round surrounding a perimeter of the base portion.

8. The ground contact apparatus of claim 1 wherein:
- the connecting portion connects to the elongate member through a threaded post.

9. The ground contact apparatus of claim 1 further comprising:
- a substantially planar bottom surface on the base portion having raised concentric tread rings.

10. An apparatus for establishing ground contact, the apparatus comprising:
- an elongate member having a first end and a second end;
- a grip attached to the first end of the elongate member;
- a ground contact tip attached to the second end of the elongate member, the ground contact tip comprising:
  - a connecting portion which is adapted to attach with the elongate member;
  - a base portion positioned opposite the connecting portion;
  - a flexible core connecting the base portion with the connecting portion; and
  - at least one limiting ring positioned on the flexible core, each ring having a thickness and
  - where the distance between an uppermost ring and the connecting portion, the distance between adjacent rings, the distance between a lowermost ring and the base, and the thicknesses of the rings are substantially equal to one another.

11. The ground contact apparatus of claim 10 wherein:
- the flexible core allows the base portion to remain flat against the ground while the elongate member rotates about the base portion.

12. The ground contact apparatus of claim 10 wherein:
- the elongate member is adapted to rotate through a range of angles while the base portion remains flat against the ground.

13. The ground contact apparatus of claim 12 wherein:
- the range of angles is at least +25 degrees to −25 degrees as measured from the axis of the elongate member to straight vertical.

14. The ground contact apparatus of claim 10 wherein:
- the elongate member is a crutch.

15. The ground contact apparatus of claim 10 wherein:
- the elongate member is a cane.

16. An apparatus for establishing ground contact with an elongate member, the apparatus comprising:
- a connecting portion which attaches with the elongate member;
- a base portion positioned opposite the connecting portion and having a diameter;

a transition shoulder attached to the connecting portion, said shoulder increases in diameter continually from the connecting portion towards the base portion and has a lower diameter;

a flexible core connecting the base portion with the transition shoulder;

a first limiting ring positioned on the flexible core and having a diameter that is larger than the lower diameter of the transition shoulder; and a second limiting ring positioned on the flexible core and having a diameter that is larger than the first limiting ring.

17. The ground contact apparatus of claim 16 wherein:

the base has a diameter which is substantially equal to the second limiting ring.

18. The ground contact apparatus of claim 16 wherein:

the diameter of each limiting ring is at least twice the size of a diameter of the flexible core.

19. The ground contact apparatus of claim 16 wherein:

the base portion, transition shoulder, and limiting rings are symmetrical about a central axis.

* * * * *